US006035924A

United States Patent [19]

Graham

[11] Patent Number: 6,035,924

[45] Date of Patent: Mar. 14, 2000

[54] METHOD OF CASTING A METAL ARTICLE

[75] Inventor: Lawrence D. Graham, Chagrin Falls, Ohio

[73] Assignee: PCC Airfoils, Inc., Cleveland, Ohio

[21] Appl. No.: 09/114,511

[22] Filed: Jul. 13, 1998

[51] Int. Cl.[7] ..... B22D 27/04

[52] U.S. Cl. ..... 164/122.1; 164/122.2

[58] Field of Search ..... 164/122.1, 122.2

[56] References Cited

U.S. PATENT DOCUMENTS

| | | |
|---|---|---|
| 3,770,047 | 11/1973 | Kirkpatrick et al. . |
| 3,810,504 | 5/1974 | Piwonka . |
| 3,942,581 | 3/1976 | Sawyer . |
| 4,190,094 | 2/1980 | Giamei . |
| 4,222,429 | 9/1980 | Kemp . |
| 4,434,838 | 3/1984 | Sevier . |
| 4,473,105 | 9/1984 | Pryor . |
| 4,520,858 | 6/1985 | Ryntz, Jr. et al. . |
| 4,573,516 | 3/1986 | Quested et al. . |
| 4,862,947 | 9/1989 | Horton et al. . |

FOREIGN PATENT DOCUMENTS

| | | | |
|---|---|---|---|
| 4321640 | 1/1995 | Germany | 164/122.1 |

*Primary Examiner*—Kuang Y. Lin
*Attorney, Agent, or Firm*—Tarolli, Sundheim, Covell, Tummino & Szabo L.L.P.

[57] ABSTRACT

A layer of hollow spheres is floated on a fluidized bed beneath a furnace. A mold containing molten metal is heated in the furnace to melt the molten metal. The mold is then moved from the furnace through the layer of hollow spheres into the fluidized bed. As the mold moves into the fluidized bed, heat is conducted form the mold and the metal is solidified.

14 Claims, 1 Drawing Sheet

METHOD OF CASTING A METAL ARTICLE

BACKGROUND OF THE INVENTION

The present invention relates to a new and improved method of casting a metal article and more specifically, to a method which includes moving a mold into a fluidized bed.

A previously suggested method of casting a metal article includes heating a mold containing metal in a furnace to melt the metal. The mold is then moved downward into a fluidized bed. As the mold moves downward into the fluidized bed, heat is transferred from the molten metal to effect progressive solidification of the molten metal. This method of casting a metal article is disclosed in U.S. Pat. No. 4,573,516.

SUMMARY OF THE INVENTION

The present invention provides a new and improved method of casting a metal article. The method includes floating a layer of insulating material on a fluidized bed. A mold containing molten metal is moved through the layer of insulating material into the fluidized bed. The molten metal in the mold is solidified during movement of the mold through the layer of insulating material. Although the layer of insulating material could be formed in many different ways, it is preferred to form the layer of insulating material by floating hollow bodies on the fluidized bed.

BRIEF DESCRIPTION OF THE DRAWINGS

The foregoing and other features of the invention will become more apparent upon a consideration of the following description taken in connection with the accompanying drawings wherein.

DESCRIPTION OF ONE SPECIFIC PREFERRED EMBODIMENT OF THE INVENTION

Figure 1:
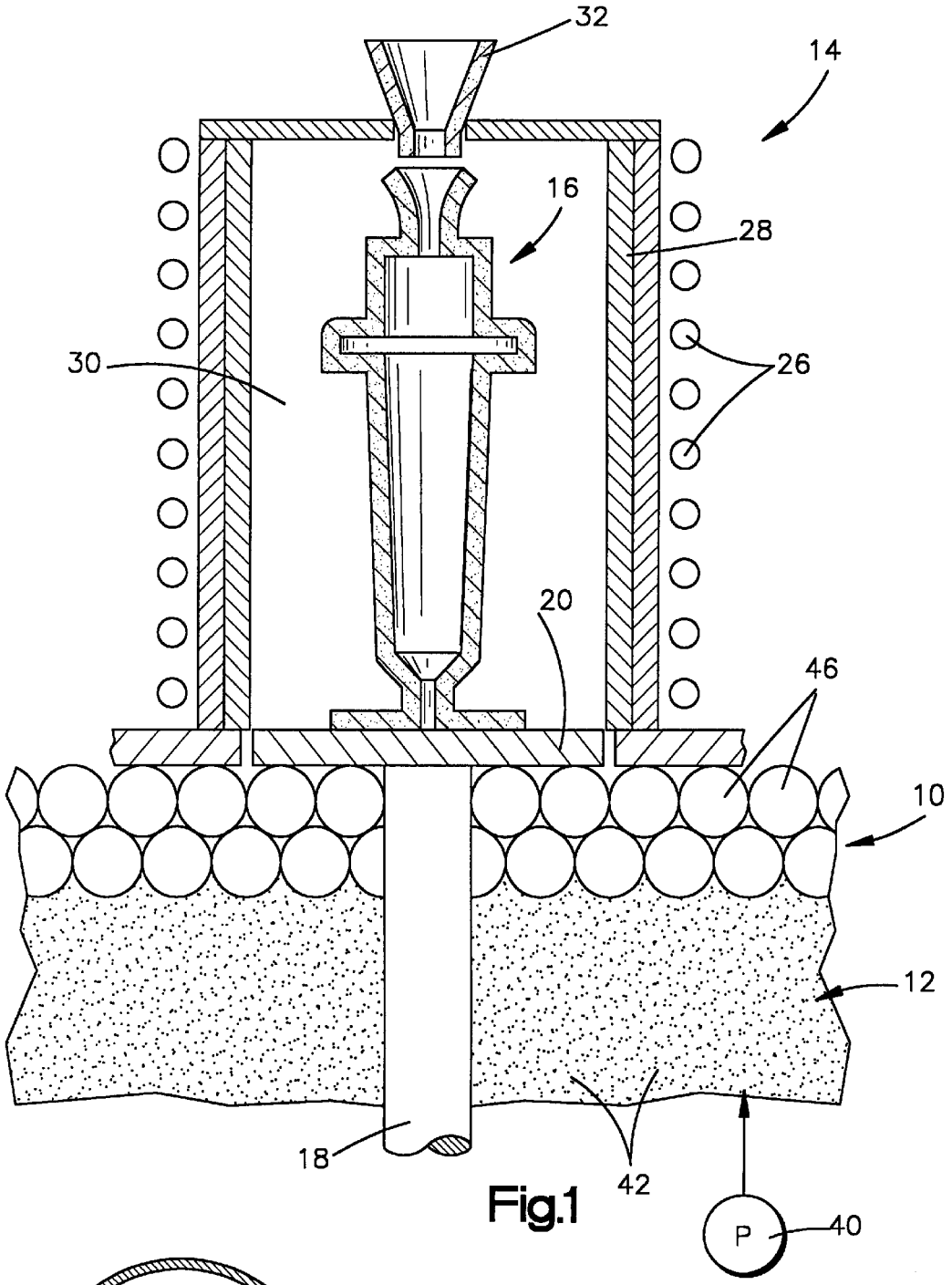
FIG. 1 is a schematic illustration depicting the manner in which a layer of insulating material is floated on a fluidized bed disposed beneath a furnace in which a mold is heated.

A layer 10 (FIG. 1) of insulating material is supported on a fluidized bed 12. The layer 10 of insulating material is disposed beneath a furnace 14 which is operable to melt metal in a mold 16. When the metal in the mold 16 has been heated to a temperature above its liquidus temperature, a support shaft 18 lowers a chill plate 20.

As the chill plate 20 is lowered, the mold 16 is moved through the layer 10 of insulating material into the fluidized bed 12. The fluidized bed 12 is maintained at a temperature below the solidus temperature of the metal in the mold 16. Therefore, as the mold 16 moves into the fluidized bed 12, the metal in the mold directionally solidifies from the lower end portion of the mold to the upper end portion of the mold. This directional solidification of the molten metal in the mold 16 is particularly advantageous when it is desired to cast a metal article with a columnar grain or to cast the metal article as a single crystal.

The furnace 14 has a known construction and includes coils 26 which extend around a cylindrical susceptor wall 28. When the coils 26 are energized, an evacuated space 30 in the furnace 14 is heated. Once the mold 16 has been heated to a desired temperature, molten metal is poured into the mold through a funnel 32. The space around the furnace 14 is also evacuated to prevent contamination of the molten metal as it is poured.

Although the mold 16 may be utilized to cast many different articles, it is believed that it will be particularly advantageous to cast an airfoil formed of a nickel-chrome super alloy. However, it should be understood that the method of the present invention is not to be limited to the casting of any particular article, from any particular metal. For example, the method of the present invention could be used during the casting of articles formed of titanium or other metals and having any desired configuration.

The fluidized bed 12 is formed by utilizing a pump 40 to supply a flow of inert gas under pressure. The pump 40 provides a flow of inert gas which is sufficient to fluidize a bed of inert particles 42 formed of alumina. However, it should be understood that the inert particles 42 could be formed of a different material if desired. For example, the inert particles 42 could be formed of silicon carbide. The particles 42 are suspended in the moving inert gas provided by the pump 40 so that the particles behave like a fluid.

In accordance with a feature of the present invention, a layer 10 of insulating material is disposed on top of the fluidized bed 12. The layer 10 of insulating material is supported by the fluidized bed. Thus, the layer 10 of insulating material floats on top of the fluidized bed 12.

The inert gas supplied by the pump 40 flows through the layer 10 of insulating materials into the evacuated space around the furnace 14. The layer 10 of insulating materials facilitates the establishing and maintaining of a temperature differential between the fluidized bed 12 and the space 30 above the layer of insulating material. This facilitates heating of the mold and/or metal in the mold by operation of the furnace 14.

The layer 10 of insulating material is advantageously formed by a large number of small hollow bodies which float on the fluidized bed 12. In the illustrated embodiment of the invention, hollow spherical bodies or balls 46 are utilized to form the layer 10 of insulating materials. However, it is contemplated that hollow bodies having a configuration other than spherical could be utilized to form the layer 10 of insulating material. If desired, the layer 10 of insulating material could be formed of material other than hollow bodies. However, since hollow bodies are relatively easy to float on the fluidized bed 12, it is believed that it may be preferred to form the insulating layer 10 of hollow bodies.

Figure 2:
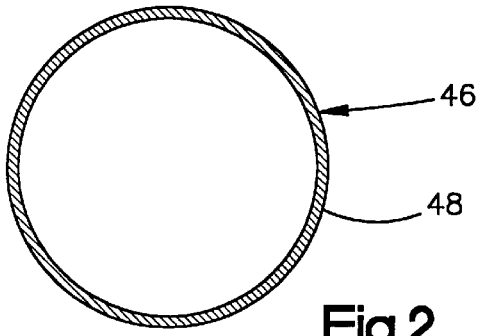
FIG. 2 is a sectional view of one of a plurality of hollow bodies which form the layer of insulating material in FIG. 1.

The hollow spherical bodies or balls 46 have a very thin shell or wall 48 (FIG. 2). The shell or wall 48 has a spherical configuration. The hollow spherical bodies 46 have a lower density than the particles 42 of the fluidized bed 12. This enables the hollow spherical bodies 46 to float on the fluidized bed 42.

The hollow spherical bodies 46 are not, themselves, fluidized. Therefore, the hollow spherical bodies 46 remain generally stationary relative to the furnace 14 while the particles 42 are continuously moving in the flow of inert gas supplied by the pump 40. The inert gas flows from the fluidized bed 12 through the layer 10 of insulating material into the evacuated space above the layer of insulating material.

In one specific embodiment of the invention, the inert particles 42 were particles of alumina having a particle size of approximately 60 microns. The hollow spherical bodies 46 were formed of alumino silicate and had a diameter of 1 to 2 millimeters. However, it should be understood that the particles 42 and the hollow spherical bodies 46 could be formed of many different materials have many different sizes, other than the specific materials and sizes set forth above.

In the aforementioned specific embodiment of the invention, the hollow spherical bodies 46 were commercially provided by Keith Ceramic Materials, Ltd., Fisher's Way, Crabtree Manorway, Belevedere, Kent, DA17 6BN England. The hollow spherical bodies 46 were obtained under the designation "Holosphere-Type M". The hollow spherical bodies 46 had the following chemical analysis:

| | % |
|---|---|
| $Al_2O_3$ | 72.0 |
| $S_1O_2$ | 24.9 |
| $T_1O_2$ | 0.1 |
| $Fe_2O_3$ | 0.6 |
| CaO | 0.1 |
| MgO | 0.1 |
| $K_2O$ | 0.8 |
| $Na_2O$ | 0.3 |

The hollow spherical bodies had a fired bulk density of approximately 1550 $Kg/m^3$ and a porosity of approximately 50. In the 1.5 to 3 mm diameter range, the hollow spherical bodies 46 have a loose bulk density of approximately 700 $Kg/m^3$. In the range of diameters of 0.5 to 1.5 mm, the hollow spherical bodies 46 had a loose bulk density of 650 $Kg/m^3$. Of course, the hollow spherical bodies 46 could have different characteristics if desired. It should be understood that the foregoing characteristics for the hollow spherical bodies have been set forth herein merely for purposes of clarity of description but not for purposes of limitation of the invention.

It is preferred to use the previously described hollow spherical bodies 46 to form the insulating layer 10. However, the insulating layer 10 could be formed of materials other than the hollow spherical bodies 46. In fact, the insulating layer 10 may be formed of materials which are not spherical and/or are not hollow. It is believed that it will be preferred to form the insulating layer 10 of relatively light weight materials which can be readily floated on top of the fluidized bed 12.

When an article is to be cast in the mold 16, the mold is placed on the chill plate 20 and moved into the furnace 14. The coils 26 of the furnace are energized to heat the mold 16. Molten metal is poured into the preheated mold 16 through the funnel 32 in a known manner. The furnace 14 maintains the molten metal, mold 16, and space 30 at a temperature above the solidus temperature of the molten material.

The pump 40 is operated to induce a flow of inert gas, such as argon, to form the particles 42 into the fluidized bed 12. The particles 42 are suspended in the flow of inert gas from the pump 40 so that there is flowing movement of the particles and the particles behave like a fluid. The hollow spherical bodies 46 float on the fluidized bed 12 to form the layer 10 of insulating material. The hollow spherical bodies 46 are not fluidized and are relatively stationary, compared to the particles 42, relative to the furnace 14. Although it is preferred to use hollow spherical bodies 46, bodies having any desired configuration could be utilized to form the layer 10 of insulating material.

The mold 16 and molten metal is then removed from the furnace 14 through the layer 10 of insulating material into the fluidized bed 12. To lower the mold 16 from the furnace 14, a support shaft 18 is moved downward (as viewed in FIG. 1). This causes the chill plate 20 to move through the layer 10 of insulating material into the fluidized bed 12.

As the mold 16 moves into and through the insulating layer 10, the lower end portion of the mold 16 is exposed to the particles 42 in the fluidized bed 12. Since the particles 42 are in constant motion under the influence of the flow of inert gas from the pump 40, the particles impact against the lower end portion of the mold 16 to effect a transfer of heat from the mold 16 to the fluidized bed 12. Heat is transferred from the hot mold 16 to the relatively cool fluidized bed 12 by a combination of conduction, convection and radiation as the particles 42 are moved around and into engagement with the hot mold 16 by the flow of relatively cool gas from the pump 40. As the mold 16 is cooled, the molten metal solidifies upward from the lower end portion of the mold 16 toward the upper end portion of the mold.

The hollow spherical bodies 46 in the layer 10 of insulating material impinge against the outer surface of the mold 16 to block the transmission of heat from the evacuated space 30 and the space around the furnace 14 to the fluidized bed 12. This results in the metal in the portion of the mold 16 remaining in the furnace 14 being molten and the metal in the lower end portion of the mold being solid. As the mold 16 is slowly lowered from the furnace 14 through the insulating layer 10 into the fluidized bed 12, the molten metal in the portion of the mold moving into the fluidized bed solidifies.

At this time, the temperature of the evacuated space 30 is above the liquidus temperature of the molten metal in the mold 16. However, the fluidized bed is at a temperature which is below the solidus temperature of the metal in the mold 16. Although the temperature in the evacuated space 30 in the furnace 14 may vary within a range of temperatures, the temperature in the evacuated space 30 is maintained at or above the liquidus temperature of the metal in the mold 16. Although the temperature of the fluidized bed 12 may vary within a range of temperatures, the temperature of the fluidized bed is maintained at a temperature which is at or below the solidus temperature of the metal in the mold 16.

The support shaft 18 slowly lowers the chill plate 20 and mold 16 into the fluidized bed 12. As this occurs, the hollow spherical bodies 46 in the layer 10 of insulating material engage the outer side surface of the mold so that the opening through the layer 10 of insulating material conforms to the configuration of the outer side surface of the mold. This minimizes heat transfer between the relatively hot evacuated space 30 and the relatively cool fluidized bed 12. Once the upper end portion of the mold 16 has moved below the layer 10 of insulating material and the molten metal in the mold has solidified, operation of the pump 40 is interrupted and the fluidized bed 12 is collapsed. The mold 16 and the solidified metal article in the mold are then removed from the chill plate 20.

Conclusion

In view of the foregoing description, it is apparent that the present invention provides a new and improved method of casting a metal article. The method includes floating a layer 10 of insulating material on a fluidized bed 12. A mold 16 containing molten metal is moved through the layer 10 of insulating material into the fluidized bed 12. The molten metal in the mold 16 is solidified during movement of the mold through the layer 10 of insulating material. Although the layer 10 of insulating material could be formed in many different ways, it is preferred to form the layer of insulating material by floating hollow bodies 46 on the fluidized bed 12.

Having described the invention, the following is claimed:

1. A method of casting a metal article, said method comprising the steps of floating a layer of hollow bodies on a fluidized bed, moving a mold containing molten metal through the layer of hollow bodies into the fluidized bed, and solidifying molten metal in the mold during movement of the mold through the layer of hollow bodies into the fluidized bed.

2. A method as set forth in claim 1 wherein said step of floating a layer of hollow bodies on a fluidized bed includes inducing a flow of gas through the fluidized bed and through the layer of hollow bodies.

3. A method as set forth in claim 1 wherein said step of moving a mold containing molten metal through the layer of hollow bodies into the fluidized bed includes moving the mold from a location where the temperature is above the liquidus temperature of the metal in the mold to a location in the fluidized bed where the temperature is below the solidus temperature of the metal in the mold.

4. A method as set forth in claim 1 further including the step of conducting heat from the mold to the fluidized bed as the mold is moved through the layer of hollow bodies into the fluidized bed.

5. A method as set forth in claim 1 wherein the hollow bodies in the layer of hollow bodies engage an outer surface of the mold as the mold is moved through the layer of hollow bodies into the fluidized bed.

6. A method of casting a metal article, said method comprising the steps of providing a layer of insulating material on top of a fluidized bed, said step of providing a layer of insulating material on top of a fluidized bed includes supporting the layer of insulating material with the fluidized bed, maintaining the temperature of a space disposed above the layer of insulating material within a first range of temperatures, maintaining the temperature of the fluidized bed within a second range of temperatures which is colder than the first range of temperatures, moving a hot mold which is at a temperature above the temperature of the fluidized bed through the layer of insulating material into the fluidized bed, and transmitting heat from the mold to the fluidized bed.

7. A method as set forth in claim 6 further including the step of engaging the mold with the layer of insulating material during performance of said step of moving the hot mold through the layer of insulating material.

8. A method as set forth in claim 6 wherein said step of providing a layer of insulating material on top of a fluidized bed includes floating a layer of insulating material on the fluidized bed.

9. A method as set forth in claim 6 wherein said step of providing a layer of insulating material on top of a fluidized bed includes providing a layer of hollow members on top of the fluidized bed.

10. A method as set forth in claim 6 further including the step of heating the mold while the mold is disposed in the space above the layer of insulating material and prior to performance of said step of moving a hot mold through the layer of insulating material into the fluidized bed.

11. A method as set forth in claim 6 wherein said step of maintaining the temperature of a space disposed above the layer of insulating material within a first range of temperatures includes heating the space disposed above the layer of insulating material to a temperature above a liquidus temperature of metal in the mold, said step of maintaining the temperature of the fluidized bed within a second range of temperatures includes maintaining the fluidized bed at a temperature below a solidus temperature of the metal in the mold.

12. A method as set forth in claim 6 wherein said step of supporting the layer of insulating material with the fluidized bed includes inducing a flow of gas through the layer of insulating material.

13. A method comprising the steps of establishing a fluidized bed formed of particles suspended in a flow of gas, providing a plurality of hollow bodies, supporting a layer of the hollow bodies on the fluidized bed, conducting the flow of gas through the layer of hollow bodies supported on the fluidized bed, moving a mold containing the molten metal through the layer of hollow bodies into the fluidized bed while continuing to conduct a flow of gas through the layer of hollow bodies supported on the fluidized bed, and solidifying molten metal in the mold while the mold is at least partially enclosed by the fluidized bed and while continuing to conduct a flow of gas through the layer of hollow bodies supported on the fluidized bed.

14. A method as set forth in claim 13 wherein said step of providing a plurality of hollow bodies includes providing a plurality of hollow bodies each of which has a density lower than a density of one of the particles suspended in the flow of gas.

* * * * *